United States Patent [19]

Zimmerman, Jr. et al.

[11] 4,245,880

[45] Jan. 20, 1981

[54] CONVENIENCE OUTLET

[75] Inventors: John A. Zimmerman, Jr., Hershey; William B. Long, Camp Hill, both of Pa.

[73] Assignee: AMP Incorporated, Harrisburg, Pa.

[21] Appl. No.: 17,629

[22] Filed: Mar. 5, 1979

[51] Int. Cl.[3] ..... H01R 11/01; H01R 21/02

[52] U.S. Cl. ..... 339/97 R; 339/128; 339/157 R

[58] Field of Search ..... 339/97 R, 98, 99 R, 339/22 R, 128, 157, 14 R; 174/48, 55, 58

[56] References Cited

U.S. PATENT DOCUMENTS

| | | | |
|---|---|---|---|
| 2,075,365 | 3/1937 | Smith | 339/123 |
| 2,888,662 | 5/1959 | Hammell | 339/217 |
| 3,049,688 | 8/1962 | Sinopoli | 339/12 |
| 3,171,702 | 2/1965 | Schumacher | 339/22 R |
| 3,213,189 | 10/1965 | Mitchell | 174/138 R |
| 3,336,560 | 8/1967 | Myers | 339/14 |
| 3,432,802 | 3/1969 | Ritchie | 339/128 |
| 3,860,319 | 1/1975 | Slater | 339/99 R |
| 3,860,739 | 1/1975 | Kloth et al. | 339/99 R X |
| 3,910,671 | 10/1975 | Townsend | 339/97 R |
| 3,935,637 | 2/1976 | Bunnell | 339/99 R X |
| 4,054,767 | 10/1977 | Anderson | 339/14 R X |
| 4,075,758 | 2/1978 | Parsons et al. | 339/99 R X |
| 4,113,334 | 9/1978 | Instone | 339/22 R |

*Primary Examiner*—John McQuade
*Assistant Examiner*—John S. Brown
*Attorney, Agent, or Firm*—Russell J. Egan

[57] ABSTRACT

A convenience outlet is disclosed for use in groups or alone at any point where it is desirable to have electrical power available. The individual convenience outlet has a housing of rigid insulative material enclosing terminals which have a receptacle configuration on one end adapted to mate with a conventional plug and on the opposite end are adapted to mate with conductors. The other end of each terminal is preferably profiled to effect an insulation displacement termination of a conductor but also can be profiled to mate with a terminated conductor. The terminals also include means for grounding the outlet to a mounting box, panel, or the like.

7 Claims, 11 Drawing Figures

CONVENIENCE OUTLET

BACKGROUND OF THE INVENTION

1. The Field of the Invention

The present invention relates to a convenience outlet which can be placed at any location desired and, in particular, to a convenience outlet which can be connected to a power line in several fashions.

2. The Prior Art

It is often desirable to have an electrical outlet convenient to a work area. For example, it is desirable to have an electrical outlet located within easy reach of a work bench, drafting table, or other such work area where electrical appliances could be expected to be used in conducting routine work for that area. In the past such convenience outlets have included a certain amount of inherent difficulty in both mounting the outlet, connecting the outlet to a power source, and the cost of manufacture of such a convenience outlet.

SUMMARY OF THE INVENTION

The subject convenience outlet has a housing or rigid insulative material including a main body portion and a cover portion. The main body portion includes means for mounting the outlet in a preformed aperture in a panel or the like. The cover and main body together define therein a cavity in which at least two power terminals and one ground terminal are positioned. The ground terminal includes at least one arm extending through a side wall of the housing to engage the panel thereby assuring grounding of the connector. Each power terminal and the ground terminal include a first portion adapted to terminate an associated conductor of a wiring cable and a second portion having a receptacle configuration adapted to receive a conventional plug therein. The rear cover includes apertures aligned with and providing access to the terminals of the subject outlet.

It is therefore an object of the present invention to produce a convenience outlet which can be mounted in a preformed aperture in a panel or the like at substantially any desired location and connected to a source of power by a variety of means.

It is another object of the present invention to produce a convenience outlet which will provide grounding to a mounting panel upon simple mounting of the outlet in a preformed aperture in the panel.

It is still another object of the present invention to produce a convenience outlet which can be connected to a power source by means of either a portable cord, to serve as a temporary power tap, or by conventional housewiring, including conduits or raceways, to serve as a permanent power tap.

It is a further object of the present invention to produce a convenience outlet which can be mounted in gang fashion with conductors of a cable being conveniently fed straight through to interconnect the outlets as well as to connect to a power source.

It is a still further object of the present invention to produce a convenience outlet in which the terminals engage associated conductors either by insulation piercing means integral with the terminals or by known terminals terminating the conductors and mating with the terminals of the outlet.

It is a still further object of the present invention to produce a convenience outlet which can be readily and economically manufactured and installed.

The means for accomplishing the foregoing objects and other advantages will become apparent to those skilled in the art from the following detailed description taken with reference to the accompanying drawings.

BRIEF DESCRIPTION OF THE DRAWINGS

FIG. 3 is an exploded perspective view showing the elements of the subject convenience outlet;

DETAILED DESCRIPTION OF THE PREFERRED EMBODIMENT

Figure 1:
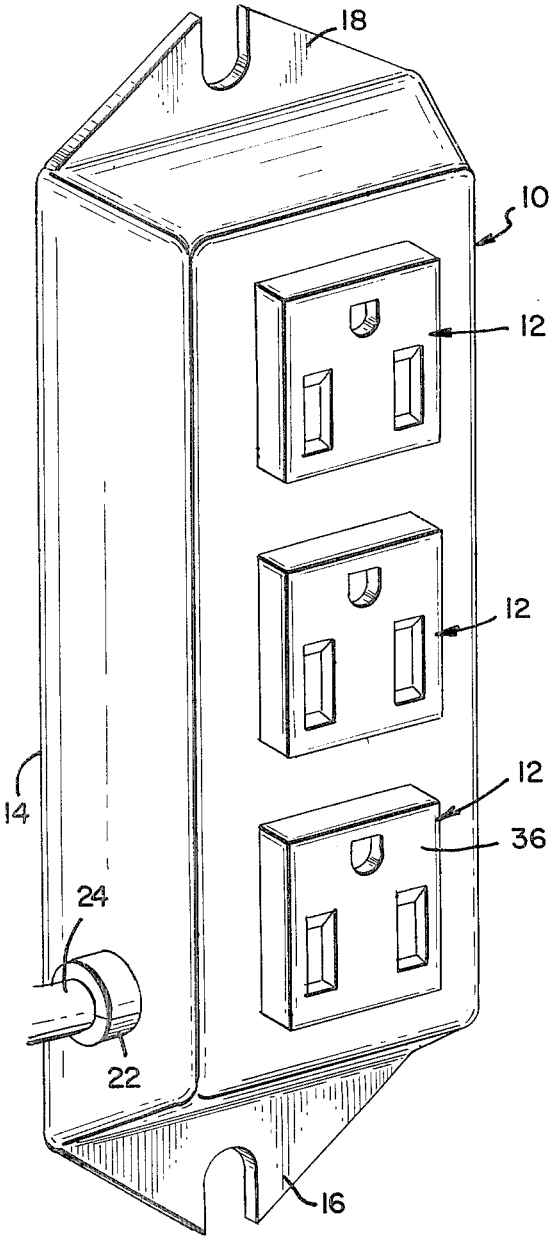
FIG. 1 is a front perspective view of a temporary power tap panel employing three convenience outlets according to the present invention.
Figure 2:
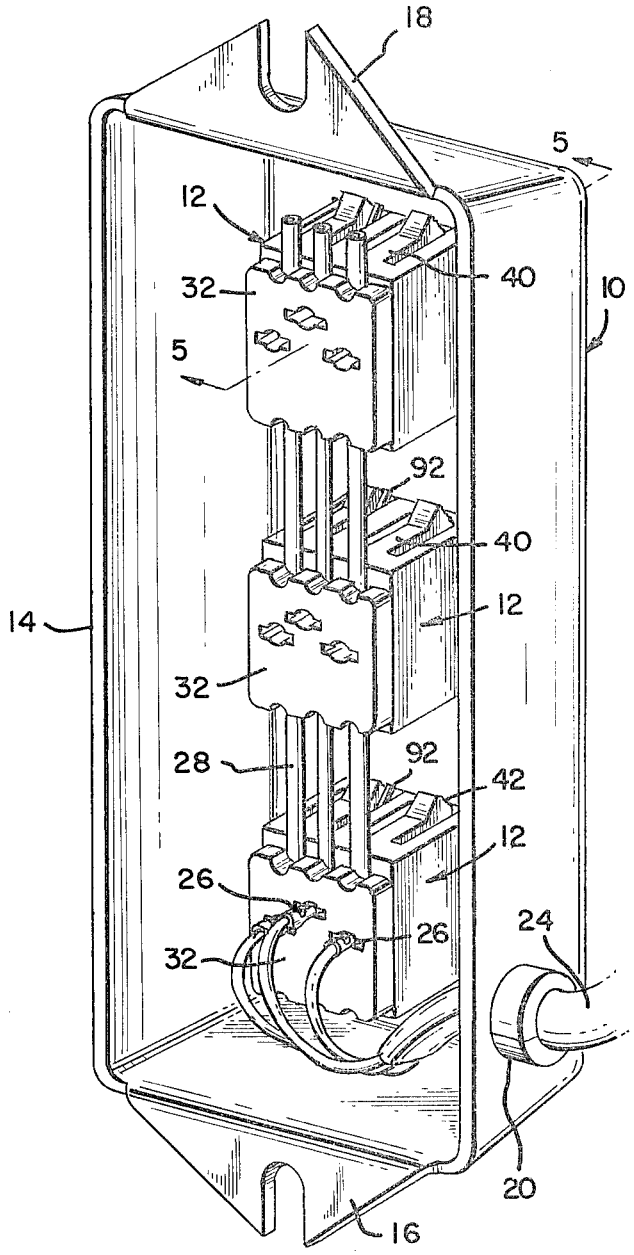
FIG. 2 is a rear perspective view of the panel shown in FIG. 1.

A temporary power tap panel 10 is shown in FIGS. 1 and 2 employing three of the subject convenience outlets 12 in a metal mounting housing 14. The housing would include mounting tabs 16, 18, and an aperture 20 with a rubber grommet 22 therein through which a power cord 24 passes. One end of the cord 24 is terminated to the end outlet 12 by means of terminals 26 and the other end is provided with a conventional plug, not shown, which can be used to connect with a standard power source such as a duplex receptacle, also not shown. The terminals 26 can be of the type shown in U.S. Pat. No. 2,888,662, the description of which is incorporated herein by reference. The outlets 12 are interconnected by conductors 28.

Figure 5:
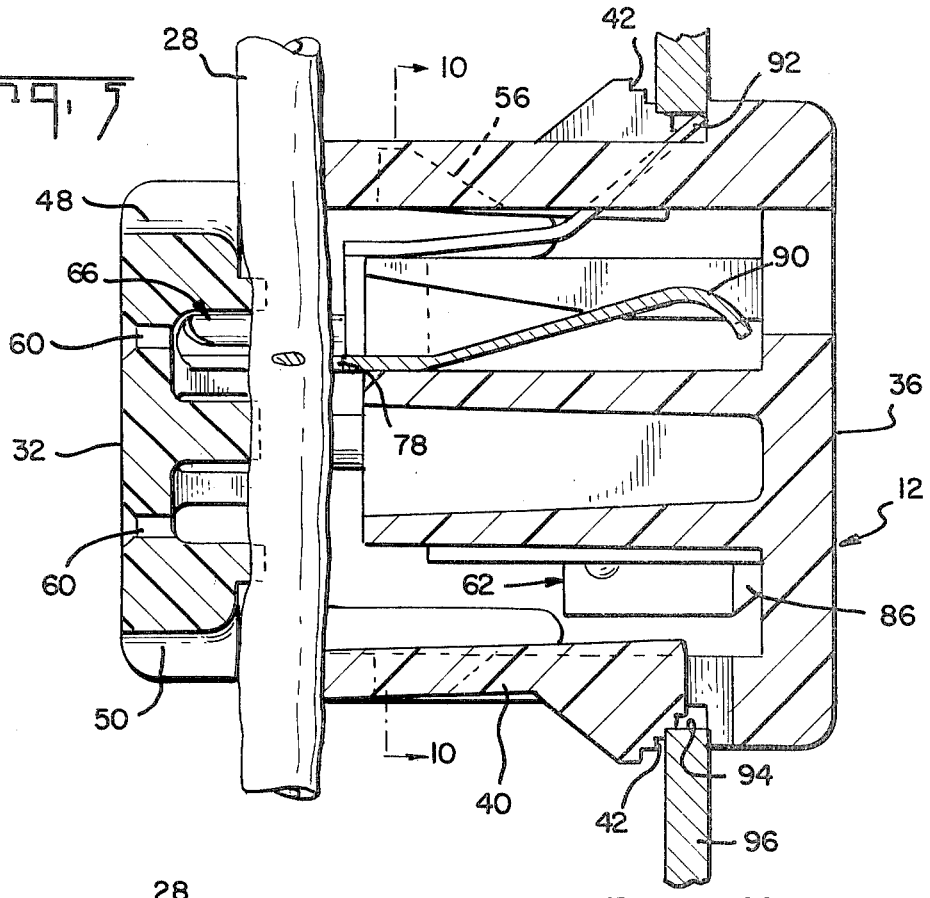
FIG. 5 is a longitudinal section through the outlet taken along line 5—5 of FIG. 10.
Figure 6:
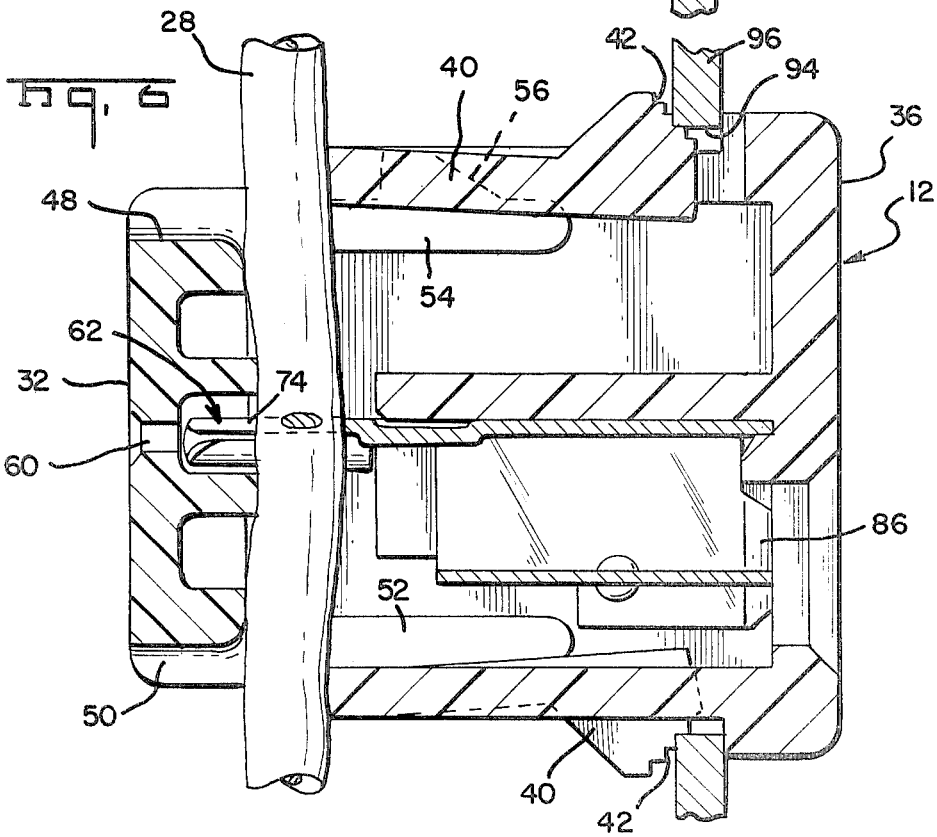
FIG. 6 is a similar section view taken along line 6—6 of FIG. 10.
Figure 7:
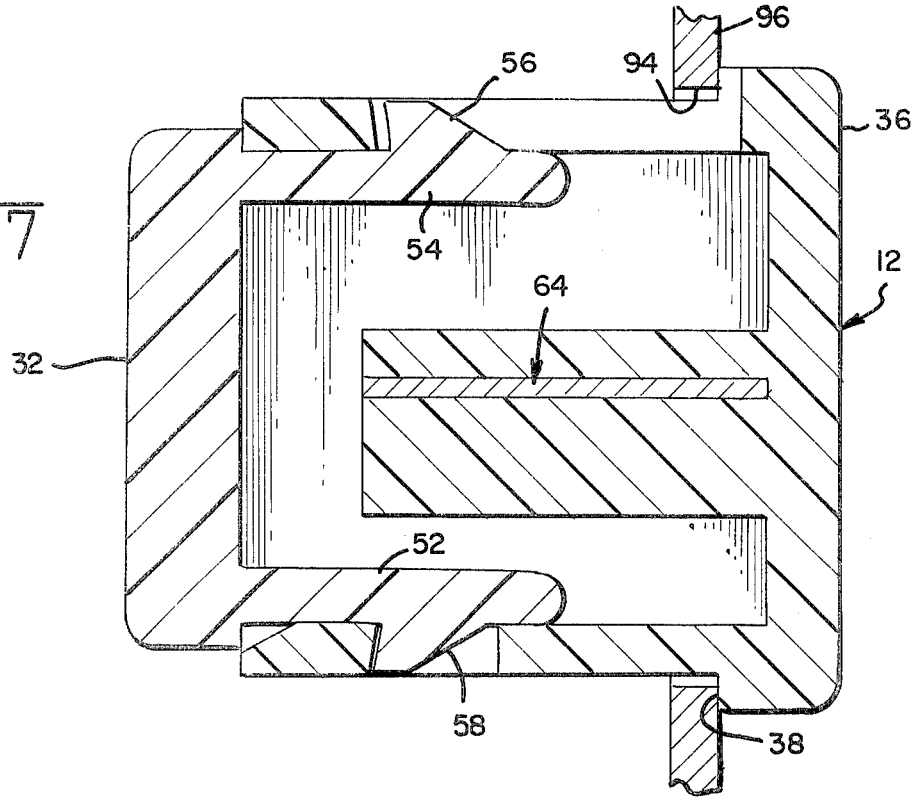

Each convenience outlet 12 according to the present invention includes a body member 30 and a rear cover 32, both made of rigid insulative material. The body member 30 and rear cover 32 together define therein a terminal cavity 34. The body member 30 also has a front mating force 36 and an outwardly directed shoulder 38 spaced to the rear of the mating face 36. The body member 30 also includes a plurality of slots defining cantilevered arms 40. Each arm 40 has a stepped profile 42 on the free end thereof, which profile allows for engagement with panels of various thicknesses, as best understood from the section views of FIGS. 5 and 6. The body member 30 also has a plurality of conductor notches 44, 46 aligned on opposing rear edges. The cover 32 includes conductor notches 48, 50 on opposing edges and a plurality of depending mounting legs 52, 54, each leg having an outwardly directed latching lug 56, 58, respectively. The cover also includes a series of apertures 60 each aligned with a respective terminal in the outlet 12.

The outlet 12 also includes two power terminals 62, 64 and a ground terminal 66. Each terminal 62, 64, 66 includes a folded plate portion 68, 70, 72 which define an insulation displacing, conductor engaging slot 74, 76, 78, respectively, for receiving a conductor therein. The folded sidewalls of the plate portions 68, 70, 72 define receptacles 80, 82, 84 adapted to receive the terminals 26. The power terminals 62, 64 also include a front end 86, 88 adapted to mate with tines of a conventional power plug, not shown, in known fashion. The ground terminal 66 includes a mating grounding blade 90 adapted to engage the ground tine of the power plug and at least one cantilever grounding leg 92 having an outurned end which will project through a slot defining a cantilever arm 40, as can be seen in FIGS. 4 and 5.

The subject convenience outlet 12 is loaded with the ground and powered terminals and inserted in an aperture 94 from the front of a panel 96. It will be appreciated from FIGS. 5 and 6 that the profiled ends 42 of the cantilever legs 40 will compensate for the thickness of the panel 96 and tightly secure the outlet 12 therein. It will also be noted from FIG. 5 that the grounding leg 92 of the ground terminal 66 will engage the panel 96. The outlets 12 are interconnected by placing the insulated conductors 28 into the appropriate notches 44, 46 of the body member 30 and terminating them in known fashion by forcing the conductors 28 into the appropriate slotted plate portions 68, 70, 72 of the respective terminals 62, 64, 66. This can be done either without the cover by directly pushing against the conductors or with the cover engaging and driving the conductors. The cover closes the rear of the outlet and also acts as a strain relief preventing the unintended withdrawal of the conductors from the outlet. The lugs 56, 58 of the legs 52, 54, lockingly engage in slots which form the cantilever arms 40, as shown in FIGS. 4 and 5.

Figures 4, 7:
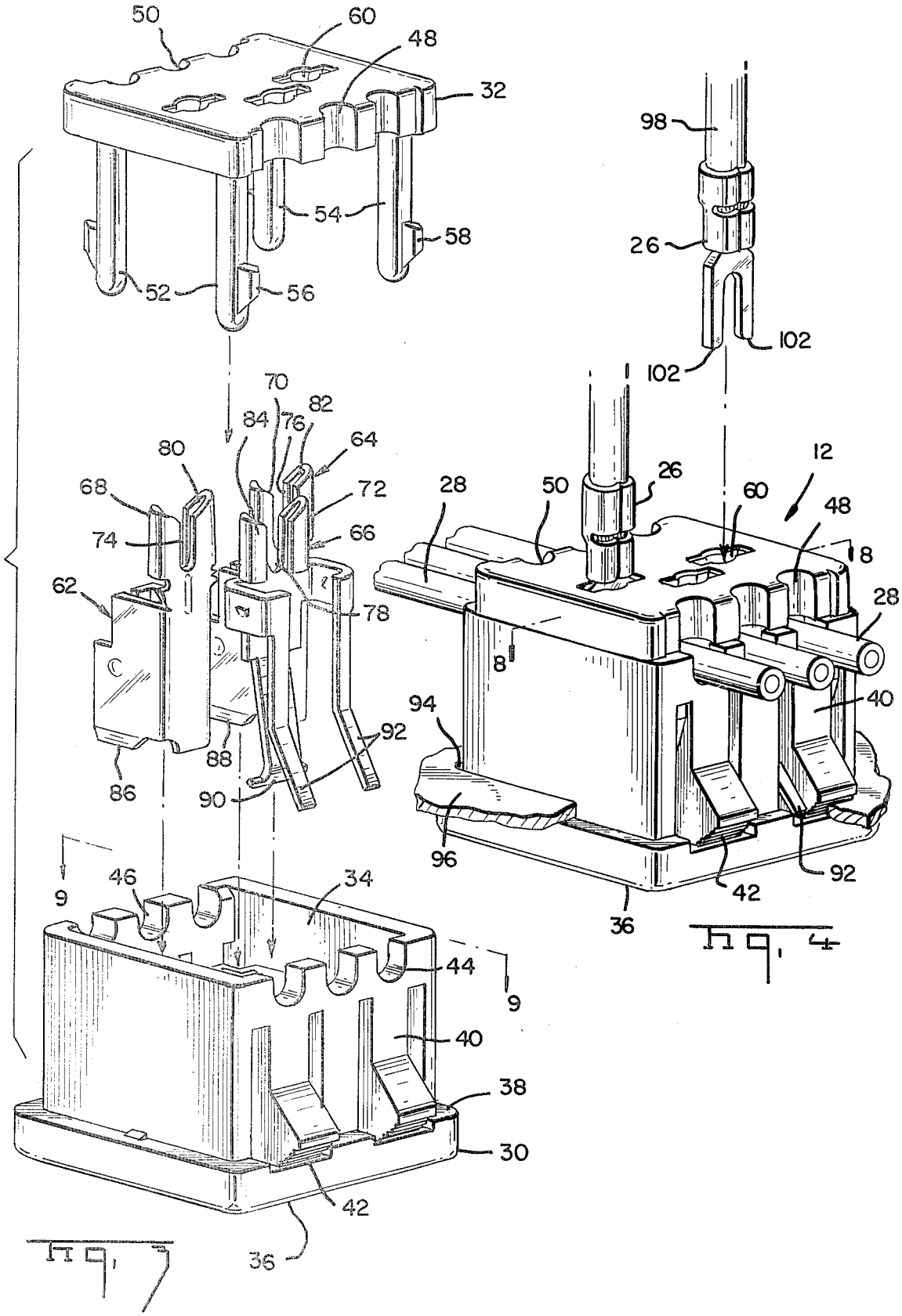
FIG. 4 is a perspective view of the convenience outlet of FIG. 3 in an assembled condition.
FIG. 7 is a further section view taken along line 7—7 of FIG. 10.
Figure 8:
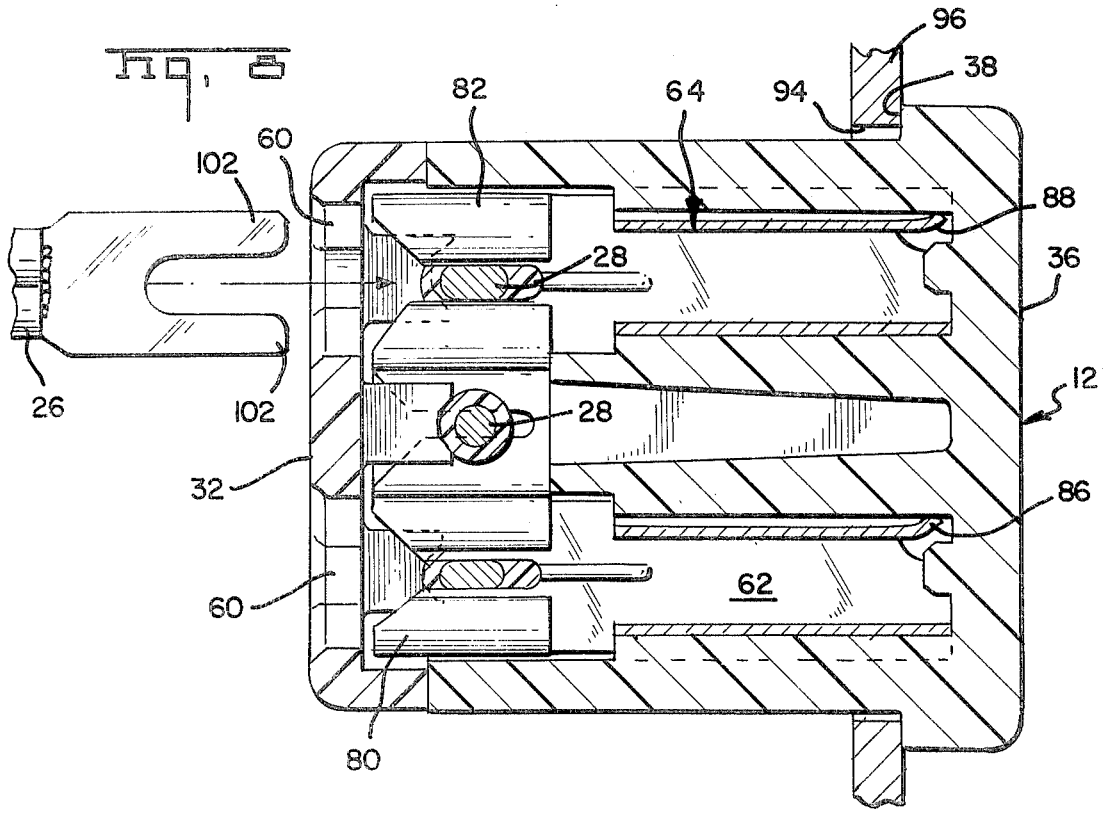
FIG. 8 is a transverse section view, rotated 90° from the section views of FIGS. 5 to 7, and taken along line 8—8 of FIG. 4.
Figure 9:
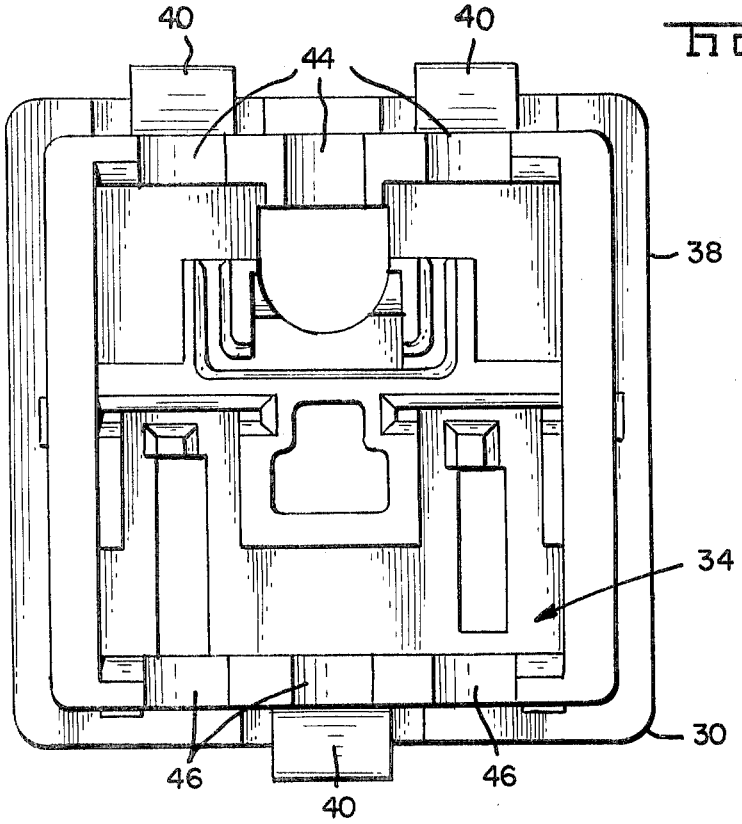
FIG. 9 is a rear elevation of the housing taken along the lines 9—9 of FIG. 3.
Figure 10:
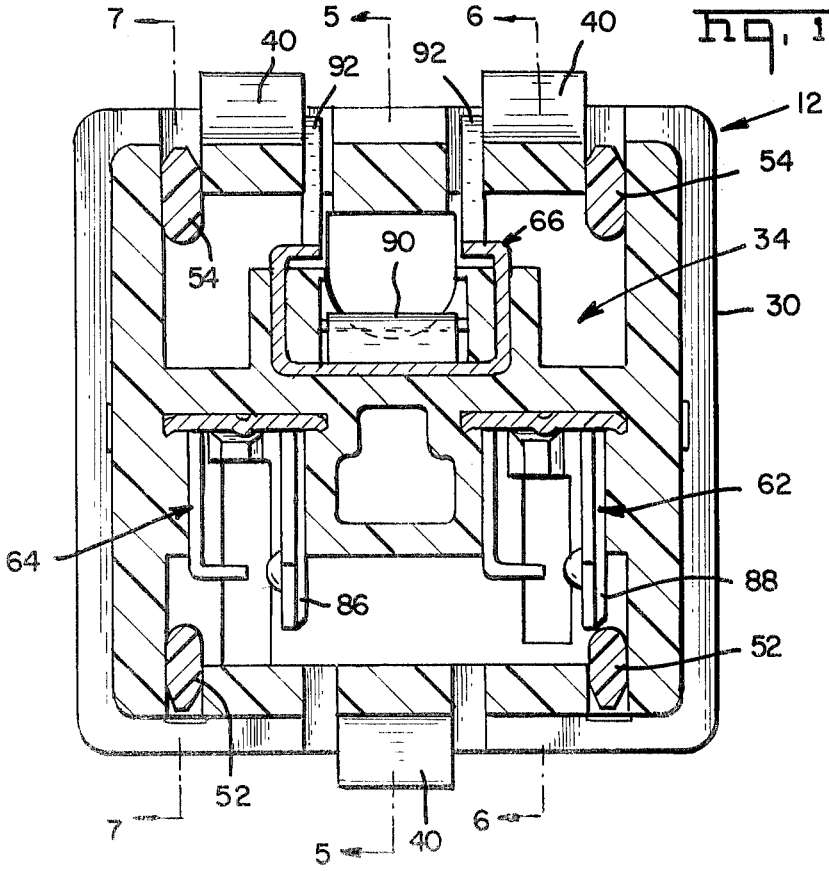
FIG. 10 is a transverse section taken along line 10—10 of FIG. 5.

FIG. 4 shows an outlet 12 being connected to a source by means of terminals 26 attached to conductors 98 of power cord 24. The terminals are crimped onto the conductors and inserted through the apertures 60 in the rear of the cover 32. The terminals 26 each include a pair of tines 100, 102 which will pass to either side of a respective conductor 28 and engage in the receptacle portions 80, 82, 84 of the folded plate portions 68, 70, 72 of the respective terminals 62, 64, 66. This can also be seen from FIG. 8.

Figure 11:
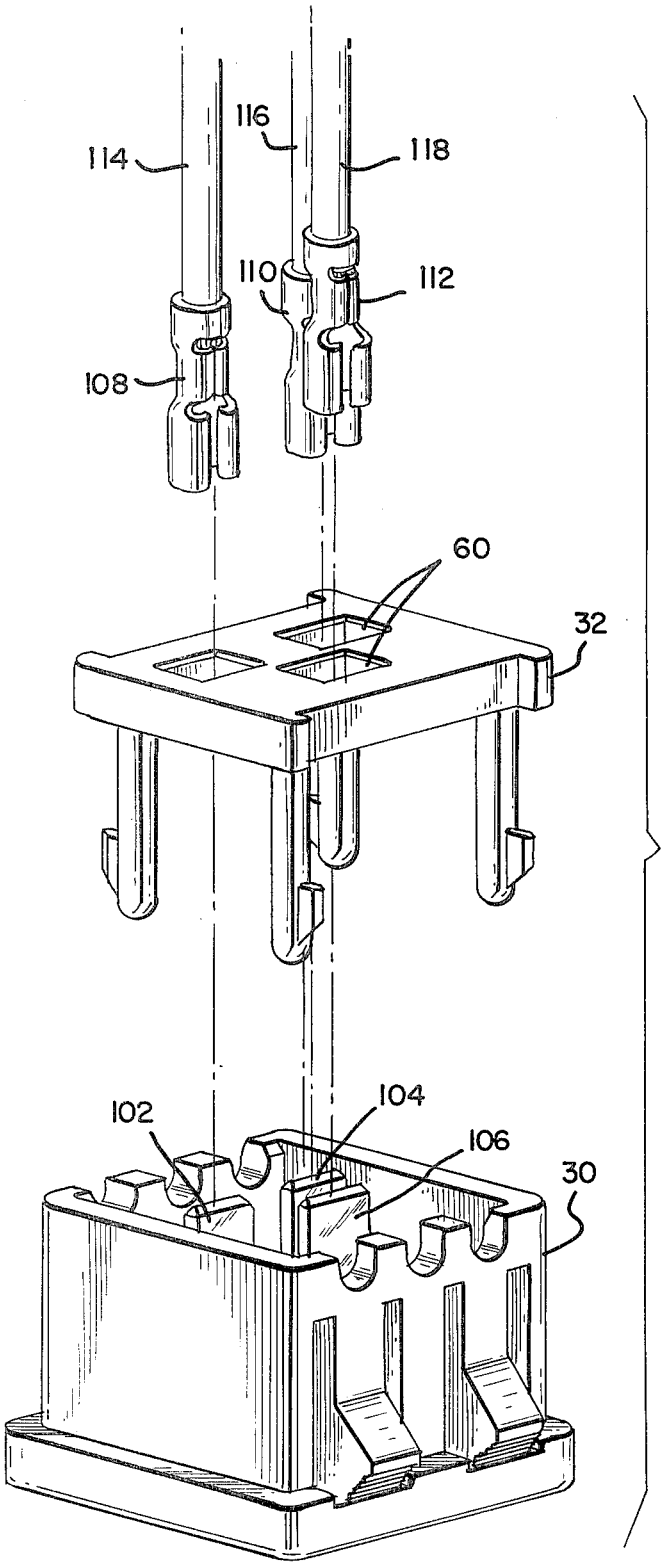
FIG. 11 is an exploded perspective view, similar to FIG. 3, showing an alternate embodiment of the convenience outlet of the present invention.

An alternate embodiment of terminals is shown in FIG. 11. In this instance the terminals 102, 104, 106 in the outlet 12 have a rearwardly directed mating blade portion and the terminals 108, 110, 112 crimped to power cord conductors 114, 116, 118 have receptacle mating portions. The terminals 108, 110, 112 are inserted into respective apertures 60 in the cover 32 to engage the blades of the respective terminals 102, 104, 106.

It should be appreciated that the present convenience outlet can also be used as a permanent installation. In these cases it will be necessary to comply with local wiring codes and include raceways, conduits or the like.

The present invention may be subject to many modifications and changes without departing from the spirit or essential characteristics thereof. The present invention is therefore to be considered in all respects as illustrative and not restrictive of the scope of the invention.

What is claimed is:

1. A convenience outlet adapted to be mounted in an aperture of a panel or the like comprising:

a housing of rigid insulative material having a forwardly directed mating face and a rearwardly opening termination cavity, at least two apertures in a patterned array opening in said mating face and leading to said cavity, a rearwardly directed shoulder spaced from said mating face, and mounting means including at least one forwardly directed, cantilevered mounting leg resiliently mounted on said housing, each said leg having a profiled free end directed towards said shoulder and adapted to engage one side of a panel, the opposite side of which engages said shoulder to hold the outlet therein, a rear cover member adapted to close said rear cavity and having means to detachably secure said rear cover member to said housing and a patterned array of apertures therein;

a plurality of terminals mounted in said cavity each with a mating portion directed towards a respective aperture in said mating face and a conductor engaging portion directed towards said rear cover member and accessible through said apertures in said rear cover member.

2. A convenience outlet according to claim 1 further comprising conductor guiding grooves on edges of opposing side walls at the rear of said housing, said grooves being aligned with a conductor engaging portion of a respective terminal.

3. A convenience outlet according to claim 1 wherein said conductor engaging portion of each said terminal comprises:

a slotted plate adapted to make insulation piercing engagement with a respective conductor.

4. A convenience outlet according to claim 1 wherein said conductor engaging portion of each said terminal comprises:

a socket adapted to receive a mating connector therein.

5. A convenience outlet according to claim 1 wherein said conductor engaging portion of each said terminal comprises:

a slotted plate adapted to make insulation piercing engagement with a respective conductor;

plate segments connected to each marginal edge of said slotted plate by bights and folded to lie parallel to and spaced from said slotted plate defining a receptacle therebetween;

whereby said terminal can be engaged by a conductor in said slot and a terminated conductor the terminal of which is received in said receptacle.

6. A convenience outlet according to claim 1 wherein said conductor engaging portion of each said terminal comprises:

a blade adapted to be received in a mating socket terminal.

7. A convenience outlet according to claim 1 wherein one of said terminals is a ground terminal and further comprises:

a grounding tine projecting from said housing to engage the panel in which said outlet is mounted.

* * * * *